US006104890A

United States Patent [19]

Kim

[11] Patent Number: 6,104,890

[45] Date of Patent: Aug. 15, 2000

[54] ELECTROPHOTOGRAPHIC DEVICE AND DENSITY CONTROL METHOD THEREOF

[75] Inventor: Nam-ryoung Kim, Suwon, Rep. of Korea

[73] Assignee: SamSung Electronics Co., Ltd., Suwon, Rep. of Korea

[21] Appl. No.: 09/076,892

[22] Filed: May 13, 1998

[30] Foreign Application Priority Data

May 13, 1997 [KR] Rep. of Korea ..... 97/18583

[51] Int. Cl.[7] ..... G03G 15/00

[52] U.S. Cl. ..... 399/46; 399/49; 399/303

[58] Field of Search ..... 399/49, 74, 39, 399/41, 46, 51, 53, 55, 59, 60, 298, 299, 300, 303, 223; 347/115; 358/296, 298; 356/372, 445, 448, 226

[56] References Cited

U.S. PATENT DOCUMENTS

| | | | |
|---|---|---|---|
| 4,277,162 | 7/1981 | Kasahara et al. | 399/49 |
| 4,519,695 | 5/1985 | Murai et al. . | |
| 4,572,654 | 2/1986 | Murai et al. . | |
| 4,816,924 | 3/1989 | Sekiya . | |
| 4,910,557 | 3/1990 | Imai . | |
| 4,965,634 | 10/1990 | Bando . | |
| 4,980,726 | 12/1990 | Aoki . | |
| 5,057,870 | 10/1991 | Aoki . | |
| 5,103,260 | 4/1992 | Tompkins et al. . | |
| 5,124,751 | 6/1992 | Fukui et al. . | |
| 5,148,221 | 9/1992 | Gokita . | |
| 5,175,585 | 12/1992 | Matsubayashi et al. . | |
| 5,198,861 | 3/1993 | Hasegawa et al. . | |
| 5,216,469 | 6/1993 | Yamada . | |
| 5,227,842 | 7/1993 | Hayashi et al. . | |
| 5,235,385 | 8/1993 | Rushing et al. . | |
| 5,237,370 | 8/1993 | Murai . | |
| 5,250,988 | 10/1993 | Matsuura et al. . | |
| 5,253,018 | 10/1993 | Takeuchi et al. . | |
| 5,258,248 | 11/1993 | Tokuhashi et al. . | |
| 5,311,261 | 5/1994 | Nakagama et al. . | |
| 5,374,950 | 12/1994 | Yasuda et al. . | |
| 5,469,244 | 11/1995 | Ogata et al. . | |
| 5,475,476 | 12/1995 | Hori . | |
| 5,477,312 | 12/1995 | Hori . | |
| 5,504,557 | 4/1996 | Morita | 399/56 |
| 5,570,165 | 10/1996 | Koike . | |
| 5,682,572 | 10/1997 | Mural et al. . | |
| 5,708,918 | 1/1998 | Okuno et al. . | |
| 5,722,003 | 2/1998 | Suzuki et al. . | |
| 5,722,009 | 2/1998 | Haneda et al. | 399/60 |
| 5,752,126 | 5/1998 | Muramatsu | 399/46 X |

FOREIGN PATENT DOCUMENTS

| | | |
|---|---|---|
| 5-2302 | 1/1993 | Japan . |

*Primary Examiner*—Arthur T. Grimley
*Assistant Examiner*—Sophia S. Chen
*Attorney, Agent, or Firm*—Robert E. Bushnell, Esq.

[57] ABSTRACT

An electrophotographic device and a density control method are disclosed. In the apparatus such as a color laser beam printer and a copier using an electrophotographic developing method, the invention obtains an optimum print output regardless of the remaining toner or other contamination by locating a density control module inside of a transfer body, and by providing a transparent window in a dielectric sheet formed on the exterior surface of the transfer body.

26 Claims, 4 Drawing Sheets

ELECTROPHOTOGRAPHIC DEVICE AND DENSITY CONTROL METHOD THEREOF

CLAIM OF PRIORITY

This application makes reference to, incorporates the same herein, and claims all benefits accruing under 35 U.S.C. §119 from an application for ELECTROPHOTOGRAPHIC DEVICE AND DENSITY CONTROL METHOD THEREOF earlier filed in the Korean Industrial Property Office on the $13^{th}$ of May 1997 and there duly assigned Ser. No. 18583/1997.

BACKGROUND OF THE INVENTION

1. Technical Field

The present invention relates to an electrophotographic device such as a color laser beam printer and a color copier using an electrophotographic developing method, and more particularly to an electrophotographic device and a density control method thereof capable of obtaining an optimum print output by detecting accurately the density of toner images formed on the surface of a photosensitive body over the entire optical region.

2. Related Art

Generally, in image forming devices using an electrophotographic developing method, such as a color copier, a color printer, etc., a charging roller is rotated and evenly charges a photosensitive body on the outer periphery of a photosensitive drum with a high pressure.

Moreover, the photosensitive body which is charged on the outer periphery of the photosensitive drum forms an electrostatic latent image by a light emitted from an optical source of an exposing device such as a laser diode which changes a digital signal to a laser beam.

At this time, the electrostatic latent image formed on the photosensitive drum is developed by a toner when passing through a developer, and then it is changed into a visible image. Simultaneously, a printable medium which is transported and fed by a pickup roller is charged and the visible image is transferred onto the printable medium.

After the image is fixed by the heat and pressure of a fixing unit, the transferred paper is ejected.

When power is supplied to the above electrophotographic device, the device warms up during a predetermined time according to its characteristic. When completing the warming up, the device is in an on-line mode capable of performing a print command.

Moreover, in the case that the print command is not received in on-line mode during a predetermined time, the device is in standby mode. In the case that the print command is received when the device is in the standby mode, the device performs the printing operation after warming up.

The electrophotographic developing methods and devices of the prior art are burdened by disadvantages. Specifically, the density of a toner image formed in accordance with such a method and device is detected through a density control module, and the density of each toner image is adjusted by controlling a developing bias and an electronic potential of a latent image according to the detected value of density. However, since the density control module of such devices is located at a position facing a photosensitive drum or device exposed to contamination, residual toner or dust comes to rest on a light receiving window and a light emitting window of the density control module, and this degrades the sensitivity of the receiving and the emitting windows. As a result, the degree of reflection occurring in such an arrangement is degraded, and this causes degradation of the characteristics of the system. In addition, it is impossible to adjust the exact density of the toner.

In such devices of the prior art, the solution to the problem has resided in cleaning of the light emitting and receiving windows. However, these windows are hard to clean due to the difficulty in disassembling the machine and then reassembling it, both of which steps are necessary in order to clean the windows. In addition, it is not preferable to clean these windows frequently because damage can occur during the disassembly and reassembly of the components.

The following patents are considered to be representative of the prior art, and are burdened by the disadvantages set forth herein: U.S. Pat. No. 5,722,003 to Suzuki et al., entitled Multicolor Electrostatic recording Apparatus Having Electrostatic Recording Units For Forming Different Colors, U.S. Pat. No. 5,708,918 to Okuno et al., entitled Image Formation Apparatus That Can Maintain Appropriately Toner Density In Developing Device, U.S. Pat. No. 5,682,572 to Murai et al., entitled Image Density Control Method For AN Image Recorder, U.S. Pat. No. 5,570,165 to Koike, entitled Method Of Controlling Toner Density Detection, U.S. Pat. No. 5,504,557 to Morita, entitled Electrophotographic-Process Control Apparatus Having Improved Output-Image-Density Control Function, U.S. Pat. No. 5,477,312 to Hori, entitled Method Of Controlling Image Density, U.S. Pat. No. 5,475,476 to Murai et al., entitled Image Density Control Method For An Image Recorder, U.S. Pat. No. 5,469,244 to Ogata et al., entitled Developing Agent Density Control Method Of Varying Development Bias In Density Control, U.S. Pat. No. 5,374,950 to Yasuda et al., entitled Image Forming Apparatus To Provide Multicolor Images, U.S. Pat. No. 5,311,261 to Nakagama et al., entitled Toner Density Control Method For Image Recording Apparatus And Apparatus For The Same, U.S. Pat. No. 5,258,248 to Tokuhashi et al., entitled Image Density Control Method For AN Image Forming Apparatus, U.S. Pat. No. 5,253,018 to Takeuchi et al., entitled Toner Image Density Detecting Mechanism For Image Forming Apparatus, U.S. Pat. No. 5,250,988 to Matsuura et al., entitled Electrophotographic Apparatus Having Image Control Means, U.S. Pat. No. 5,237,370 to Murai, entitled Image Density Control Method For Image Recorder, U.S. Pat. No. 5,235,385 to Rushing, entitled Method And Apparatus For Controlling Toner Image Density, U.S. Pat. No. 5,227,842 to Hayashi et al., entitled Electrophotographic Image Forming Apparatus Which Controls Developer Bias Based On Image Irregularity, U.S. Pat. No. 5,216,469 to Yamada, entitled Apparatus For Controlling Toner Density In A Developing Device Of An Electrophotographic Or Electrostatic Image Forming Apparatus, U.S. Pat. No. 5,198,861 to Hasegawa et al., entitled Image Density Control Method For AN Image Forming Apparatus For Reducing Background Contamination Of A Photoconductive Drum, U.S. Pat. No. 5,175,585 to Matsubayashi et al., entitled Electrophotographic Copier Having Image Density Control, U.S. Pat. No. 5,148,221 to Gokita, entitled Image Forming Apparatus With Toner Density Control Based On The Medium Supplied, U.S. Pat. No. 5,124,751 to Fukui et al., entitled Image Forming Apparatus with A Toner Density Control Device, U.S. Pat. No. 5,103,260 to Tompkins et al., entitled Toner Density Control For Electrophotographic Print Engine, U.S. Pat. No. 5,057,870 to Aoki, entitled Toner Density Control Device For AN Image Forming Apparatus, U.S. Pat. No. 4,980,726 to Aoki, entitled Toner Density Control Device For An Image Forming Apparatus, U.S. Pat. No. 4,965,634 to Bando, entitled Image Recording Apparatus Capable Of Controlling Image Density, U.S. Pat. No. 4,910,557 to Imai, entitled Image Density Control Method For An Image Forming Apparatus, U.S. Pat. No. 4,816,924 to Sekiya, entitled Laser Printer With Toner Image Density Control, U.S. Pat. No. 4,572,654 to Murai et al., entitled Image Density Control Method For Electrophotography, U.S. Pat. No. 4,572,653 to Ito et al., entitled Image Density Control Apparatus For Copying Machines, and U.S. Pat. No. 4,519,695 to Murai et al., entitled Image Density Control Method For Electrophotography.

SUMMARY OF THE INVENTION

Therefore, it is an object of the present invention to control an image forming condition to be an optimum state by detecting accurately the density of a toner image over an entire optical region.

It is another object of the present invention to detect the density of the toner image by locating a density control module at a position which is covered up against a remaining toner or another contamination instead of locating it at a position facing a photosensitive body used as a photosensitive device.

Yet another object of the present invention is to miniaturize the density control module.

Still another object of the present invention is to set an optimum printing condition by controlling a gain and an offset automatically according to the reflecting degree of the toner image from the density control module.

According to one aspect of the present invention, the density control module is provided inside of a transfer unit for detecting a reflecting degree of the light on the toner image formed on the surface of the photosensitive body. A gain value and a residual offset value, corresponding to the reflecting degree of the toner image which is detected, are determined. After amplifying the reflecting degree of the toner image detected by the determined gain value and the residual offset value to a predetermined value, an electric potential of a latent image and a developing bias are controlled based on the reflecting degree of the toner image which is amplified, thereby controlling the density of the toner images having multicolors.

Preferably, in the case that the reflecting degree of the detected toner image is small, a large gain value is set. In the case that the reflecting degree of the detected toner image is large, a small gain value is set.

Preferably, in the case that the reflecting degree of the detected toner image is small, a large gain value and a large residual offset value are set. In the case that the reflecting degree of the detected toner image is large, a small gain value and a small residual offset value are set.

According to another aspect of the present invention, an electrophotographic device includes: an exposing unit for forming an electrostatic latent image on the surface of the photosensitive body based on the image information; a developing unit for forming toner images having multicolors on the electrostatic latent image; a transfer unit for transferring the toner images of multicolors onto a recordable medium which is fed and has a density control module therein; and a fixing unit for heat-fixing the toner image of multicolors transferred onto the recordable medium by heat.

As an embodiment, the density control module includes: a unit for detecting the value of the toner image formed on the surface of the photosensitive body and then amplifying and outputting a density value; a unit for selecting a gain value corresponding to the density value; and a unit for generating a density control value by amplifying the density value of the toner image detected by the density detecting unit based on the selected gain value to a predetermined level.

The transfer unit of the present invention includes: a transfer cylinder; a dielectric sheet which is formed at the outer periphery of the transfer cylinder and has a predetermined thickness; and a transparent window which is formed in the middle of the end portion of the dielectric sheet to communicably connected to the inside of the transfer cylinder.

The density detecting unit is located at the inside of the transfer unit so as to face the transparent window.

Moreover, the density detecting unit includes: a light emitting element for emitting light on the surface of the photosensitive body through the transparent window; a light receiving element for receiving the light which is transmitted from the light emitting element and reflected against the surface of the photosensitive body through the transparent window and generating an electrical signal corresponding to the reflected light; and a first amplifying unit for amplifying the electrical signal generated by the light receiving element to a predetermined level and then outputting the amplified signal.

The density control value generating unit includes: first and second gain control units which generate different gain values; and a second amplifying unit which outputs the density control value by amplifying to a predetermined level the electrical signal on the density of the toner image which is obtained by the density detecting unit based on the any one gain value selected from the first and second gain control units.

As another embodiment, the density control module includes: a unit for detecting the density value of the toner image formed on the surface of the photosensitive body and then amplifying and outputting the density value; a unit for selecting a gain value and a residual offset value corresponding to the density value; and a unit for generating the density control value by amplifying to a predetermined level the density value of the toner image which is detected by the density detecting unit based on the selected gain value and the residual offset value.

In the embodiment, the density control value generating unit includes: first and second gain control units which generate different gain values; first and second offset control units which generate different residual offset values; and a second amplifying unit which outputs the density control value by amplifying, to a predetermined level, the electrical signal related to the density of the toner image as obtained by the density detecting unit based on one gain value selected from the first and second gain control units and one residual offset value selected from the first and second offset control units.

Accordingly, since the density detecting unit is located at the inside of the transfer unit which is shielded against contamination, it is possible to detect accurately the density of the toner image which is formed at the photosensitive unit through the transparent window over the entire optical region and to correct accurately the density value of the detected toner image through the density control value generating unit, thereby controlling optimally the image forming condition on each color.

As a result, in the case that the method is applied to the apparatuses such as the color laser beam printer and the copier using the electrophotographic developing method, it is possible to prevent the degradation of the sensitivity of the density control module which is caused by the remaining toner or another contaminations. In addition, the cleaning operation which is performed periodically is excluded and the optimum print output can be obtained.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood through the preferable embodiments referring to the attached drawings.

Figure 1:
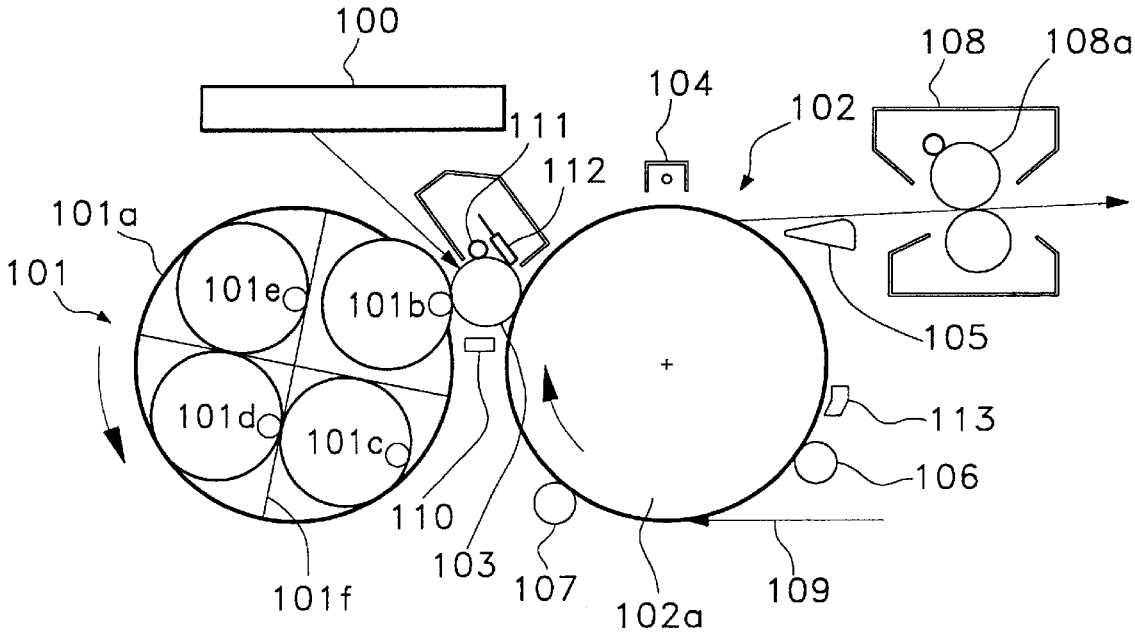
FIG. 1 is a view roughly illustrating the structure of an electrophotographic device.

FIG. 1 shows an image forming device or copier using an electrophotographic developing method. The device illustrated in FIG. 1 is explained as an example of the color copier using the conventional electrophotographic developing method.

Referring to FIG. 1, a photosensitive drum 103 is supported by a rotatable body, and the thin photosensitive body is spread on the surface layer of a conductive substrate. The photosensitive drum 103 is rotated/operated by a driving device which is not illustrated in the drawing.

Around the photosensitive drum 103, there are formed: a first charging unit 111 for charging the surface of the photosensitive drum 103 with a predetermined electric potential; an exposing device 100 such as a laser diode for forming the electrostatic latent image by exposing the surface of the photosensitive drum 103; a rotatable developing unit 101 which rotatably contacts the photosensitive drum 103 with an even pressure and forms repeatedly four colors of toner images, i.e., visible images successively at the electrostatic latent image formed on the surface of the photosensitive drum 103; and a first cleaning unit 112 for removing the remaining toner from the surface of the photosensitive drum 103.

In addition, a transfer unit 102 includes a transfer drum 102*a* supported to the rotatable body. The transfer drum 102*a* contacts the photosensitive drum 103 with a predetermined pressure and rotates clockwise (for example).

Figure 2:
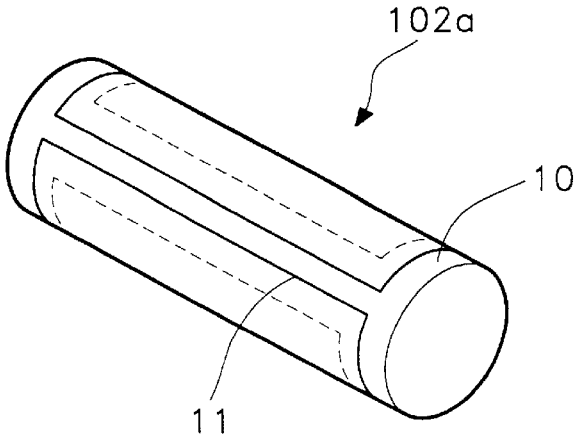
FIG. 2 is a perspective view illustrating the structure of a transfer drum of a transfer unit in FIG.1.

The transfer drum 102*a* used in the transfer unit 102, as shown in FIG. 2, includes a transfer cylinder 10 and a dielectric sheet 11 of a PET or a PVDF attached to the transfer cylinder 10.

On the surface of the transfer drum 102*a*, a transferrable medium (i.e., a recordable medium 109) is attached electrostatically or mechanically. Moreover, by applying a high charging pressure for transfer to the transfer cylinder 10 of the transfer drum 102*a*, the toner image which is formed at the photosensitive body of the photosensitive drum 103 is transferred onto the recordable medium 109.

In addition, at the upper side of the transfer drum 102*a*, a paper separation charger 104 is formed to eliminate the static electricity from the recordable medium 109 which finishes transfer. Moreover, a separating finger 105 is formed facing the transfer drum 102*a*. After transfer, The upper end of the separating finger 105 contacts the surface of the transfer drum 102*a*, thereby separating the recordable medium 109 from the transfer drum 102*a*.

At the rear part of the transfer drum 102*a*, a second cleaning unit 113 is located so as to clean the surface of the transfer drum 102*a* after transfer.

A charging roller 107 for adhesion is located at a point where the recordable medium 109 is entered so as to contact the transfer drum 102*a*, and it applies a high charging pressure for adhesion to the transfer drum 102*a* so that the recordable 109 can be adhered to the transfer drum 102*a*.

A heat roller 108*a* of the fixing unit 108 fixes the toner image of the recordable medium 109 which is separated from the transfer drum 102*a* by the separating finger 105.

Moreover, a rotatable turret 101*a* of the rotatable developing unit 101 includes four developers 101*b* to 101*e* which contain a yellow toner, a magenta toner, a cyan toner and a black toner, respectively; and a developer supporting body 101*f* of a cylindrical shape which receives the four developers 101*b* to 101*e* and is supported to the rotatable body 101.

The rotatable turret 101*a* of the rotatable developing unit 101 is rotated counterclockwise and the developers 101*b* to 101*e* move so as to face the surface of the photosensitive drum 103, thereby forming the electrostatic latent image on the surface of the photosensitive drum 103. At this time, as the developer supporting body 101*f* is rotated once, all four colors are developed.

Moreover, at the lower side of the photosensitive drum 103, a density control module 110 is located to detect the density of the toner image formed on the photosensitive body.

Figure 3:
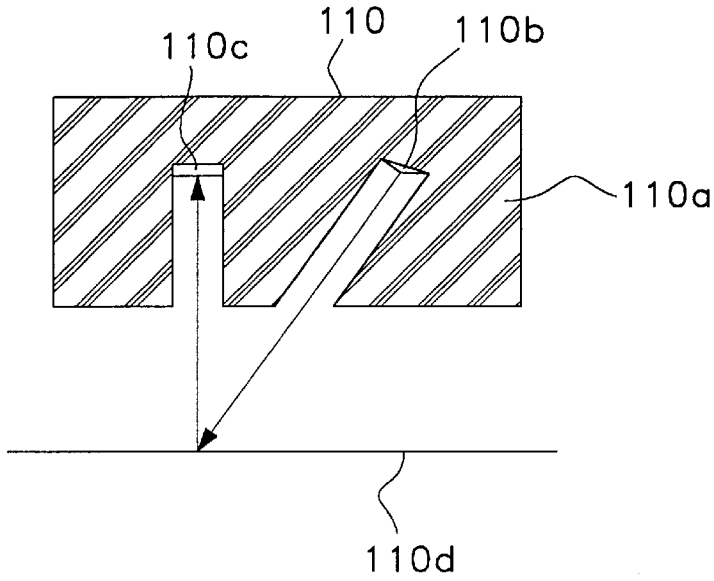
FIG. 3 is a sectional view illustrating the structure of a density control module in FIG. 1 in detail.

The density control module 110, as shown in FIG. 3, includes a light emitting element 110*b* for transmitting light to a measured surface 110*d* by a predetermined angle; a light receiving element 110*c* for receiving the light reflected by the measured surface 110*d* after being transmitted from the light emitting element 110*b* and then converting the light into an electrical signal corresponding to the quantity of the light; and a holder 110*a* for supporting the light emitting element 110*b* and the light receiving element 110*c*.

A reference numeral 106 shown in FIG. 1 which is not explained yet is an anti-electrostatic roller.

In a copier or image forming device having the above-described structure, the recordable medium 109 which is fed and transported by a pickup roller of a feeding unit (not illustrated) is adhered to the surface of the dielectric sheet 11 of the transfer drum 102*a* by the high charging pressure of the charging roller 107 for adhesion.

The charging unit 111 charges the surface of the rotating photosensitive drum 103 with a predetermined electric potential, and the exposing device such as the laser diode exposes the image of a first color, i.e., magenta color based on the image information with a predetermined timing and then forms the electrostatic latent image corresponding to the magenta color on the photosensitive body of the photosensitive drum 103.

At this time, since the developer 101*b* is carried by the turret 101*a* of the rotatable developing unit 101 facing the surface of the photosensitive drum 103, the electrostatic latent image formed on the surface of the photosensitive drum 103 is developed by the toner, and thereby the visible image is formed.

The toner image which becomes the visible image by the developing unit 101*b* is rotated up to a position facing the transfer drum 102*a* of the transfer unit 102, i.e., up to the developing position.

The toner image rotated up to the position facing the transfer drum 102*a* is transferred onto the recordable medium 109 which is adhered to the dielectric sheet 11 of the transfer drum 102*a* by the transferring voltage applied to the transfer cylinder 10.

Here, the toner remaining on the surface of the photosensitive drum 103 is removed by the first cleaning unit 112, and the photosensitive drum 103 returns to a state capable of forming an image corresponding to the next color.

When the electrostatic latent image of the second color is formed on the photosensitive drum 103, the turret 101*a* of the rotatable developing unit 101 is rotated, thereby carrying the next developer 101*c* to a position facing the surface of the photosensitive drum 103.

The electrostatic latent image formed on the surface of the photosensitive drum 103 becomes a visible image by the toner of the second color, i.e., yellow color, formed at the developer 101*c* by the aforesaid method. The toner image of the yellow color is transferred onto the surface of the recordable medium 109, onto which the magenta color is previously transferred by the transferring voltage of the transfer cylinder 10.

After the toner images of four colors are transferred onto the surface of the recordable medium 109 using the same process, the paper separation charger 104 separates the recordable medium 109 from the transfer drum 102*a*.

As described above, the toner images of all four colors are transferred and then fixed by heat having a predetermined temperature generated from the heat roller 108*a* of the fixing unit 108 onto the separate recordable medium 109, which is separated from the transfer drum 102*a* by the separation charger 104, thereby completing the printing operation.

In the copier which forms the above image, the density control module 110 located at the position facing the photosensitive drum 103 detects the density of the toner image formed on the photosensitive drum 103 and controls a density operation device (not illustrated) to have a proper density of the toner image.

As illustrated above, the density control module 110 includes: the light emitting element 110*b*, such as a light emitting diode or an incandescent light; a light receiving element 110*c*, such as a photodiode, a phototransistor or a photoconductive cell (CDs); and a holder 110*a* for supporting the light emitting element 110*b* and the light receiving element 110*c*.

Since the exposing device 100 and the developing unit 101 are operated by the aforesaid process when detecting the density, the toner image for detecting the density is formed on the surface of the photosensitive drum 103.

At this time, as shown in FIG. 3, the light emitting element 110*b* of the density control module 110 radiates the light onto the toner image formed on the surface of the photosensitive drum, i.e., the measured surface 110*d*. The light radiated from the light emitting element 110*b* is reflected by the toner image of the photosensitive drum 103 and then received by the light receiving element 110*c*. The light receiving element 110*c* generates the electrical signals according to optical quantity which is reflected and received trough the toner image.

At this time, since the optical quantity reflected against the surface of the photosensitive drum 103 varies according to the density of the toner image, the optical quantity received by the light receiving element 110*c* varies according to the density of the toner image. Accordingly, the light receiving element 110*c* generates the electrical signal corresponding to the density of the toner image and provides the signal to a density operating device.

The density operating device operates on the density of the toner image based on the electrical signal corresponding to the optical quantity received by the light receiving element 110*c* and then determines whether the operated density is a predetermined value. In the case that the density is not the predetermined value, the density of the toner image is corrected to have the predetermined value by controlling an electric potential of the latent image of a developing bias. This control operation is performed regarding the toners of the remaining colors.

Figure 4:
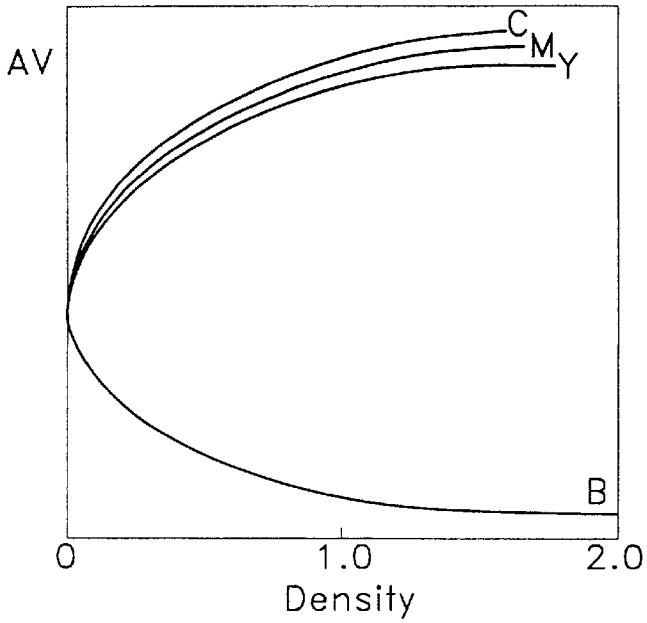
FIG. 4 is a graph illustrating the relation between a output voltage of the density control module in FIG. 1 and the toner density of four colors.

FIG. 4 is a graph illustrating the correlation between an output voltage AV of the density control module 110 and the toner density regarding the toners of magenta (M), cyan (C), yellow (Y) and black (B) colors.

As shown in the drawing, as the density of the toners of magenta, cyan, and yellow colors increases, the output voltage AV of the density control module 110 increases. This is because the reflected optical quantity increases as the toner density increases.

In the case of black toner, as the toner density increases, the output voltage AV of the density control module 110 decreases. This is because the black toner uses carbon. As the density of the black toner increases, an absorbing amount of the light transmitted from the light emitting element 110*b* of the density control module 110 increases, thereby resulting in reducing the output voltage AV due to the little optical quantity received by the light receiving element 110*c*.

In the copier using the aforesaid electrophotographic developing method, the density of the toner image formed on the photosensitive drum 103 is detected through the density control module 110. The density of each toner image is properly adjusted by controlling the developing bias and the electric potential of the latent image according to the detected value of density.

However, in the above-described copier, since the density control module is located at the position facing the photosensitive drum of the photosensitive device being exposed to contamination, the remaining toner or dust lies on a light receiving window and a light emitting window of the density control module, thereby degrading the sensitivity of the light receiving and emitting windows.

As a result, even though the optical quantity is normally transmitted/reflected to/against the measured surface to be detected, it is determined that the reflecting degree is degraded, thereby causing the degradation of the characteristic of the system. In addition, it is impossible to adjust the exact density of the toner.

Moreover, as one way of escaping from the degradation of the sensitivity in the light receiving window and light emitting window of the density control module, cleaning of the light emitting and receiving windows is considered. However, it is hard to clean them due to the difficulty in disassembling of the machine into pieces and reassembly.

In order to prevent the degradation of the sensitivity in the light receiving and emitting windows of the density control module, it is necessary to clean the windows periodically. However, it is not preferable to clean the windows frequently because damage can occur during disassembly or reassembly of the components. In other words, a compact sized density control module capable of obtaining the same or more effect and preventing the degradation of the sensitivity of the density control module is needed.

Preferred embodiments of a density control device of an electrophotographic device according to the present invention are explained in detail below.

Figure 6:
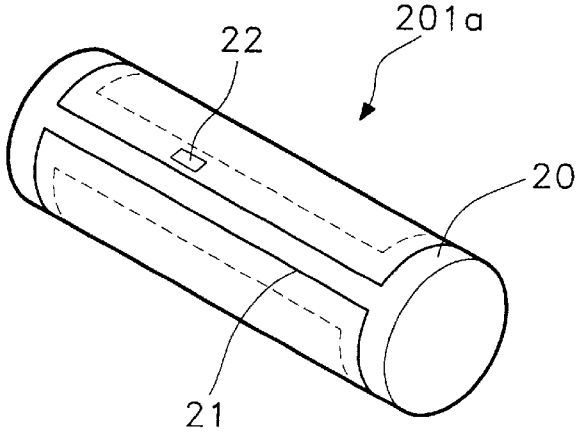
FIG. 6 is a perspective view illustrating the structure of a transfer drum of a transfer unit in FIG. 5.
Figure 7:
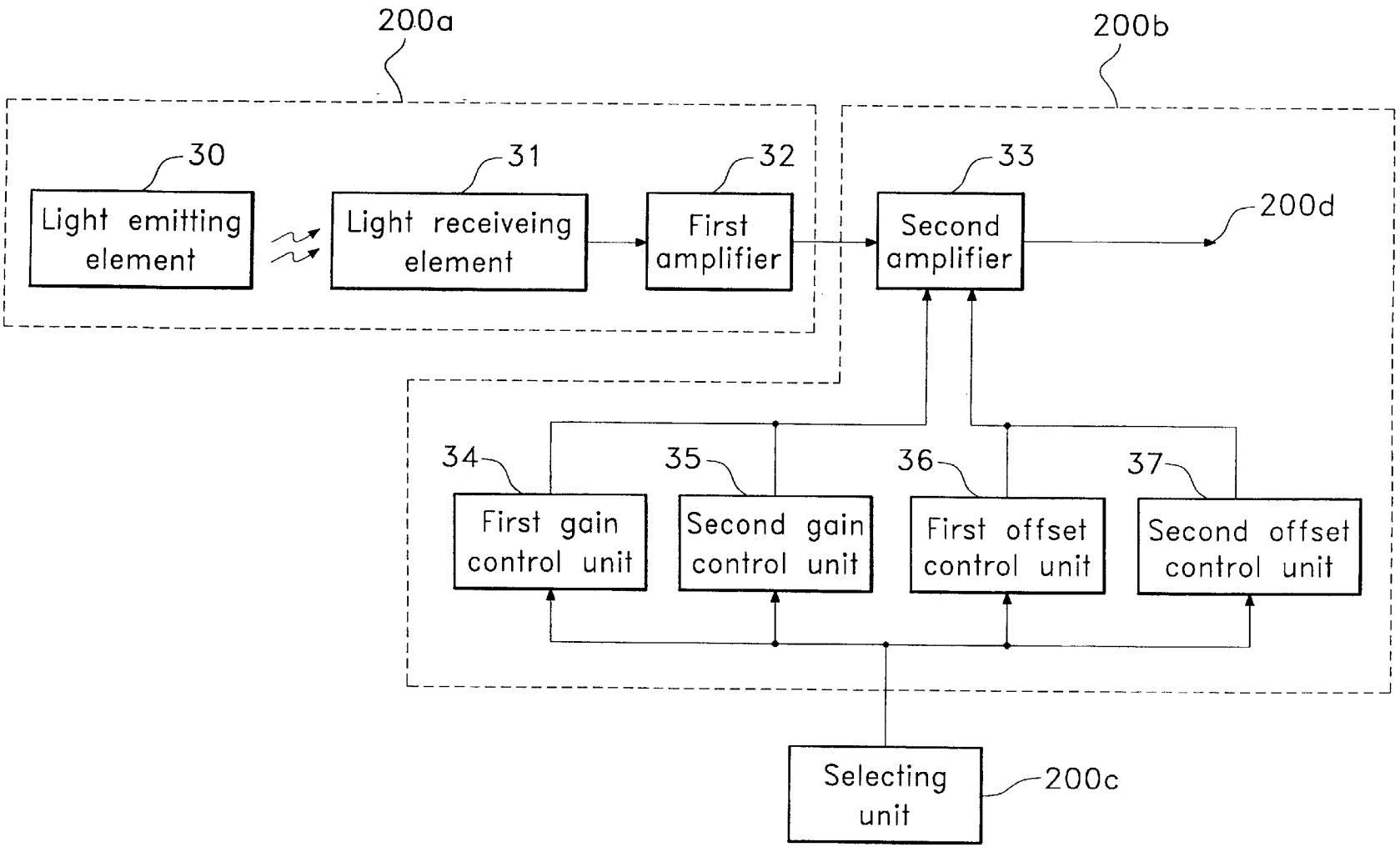
FIG. 7 is a block diagram illustrating a density control device applied to FIG. 5 according to the present invention.

The density control device of the present invention can be applied to various electrophotographic devices using an electrophotographic developing method. Here, FIGS. 5 to 7 are applied to various electrophotographic devices using the electrophotographic developing method without restriction to a specific density detecting device.

Hereinafter, a color laser beam printer using the electrophotographic developing method is explained.

Figure 5:
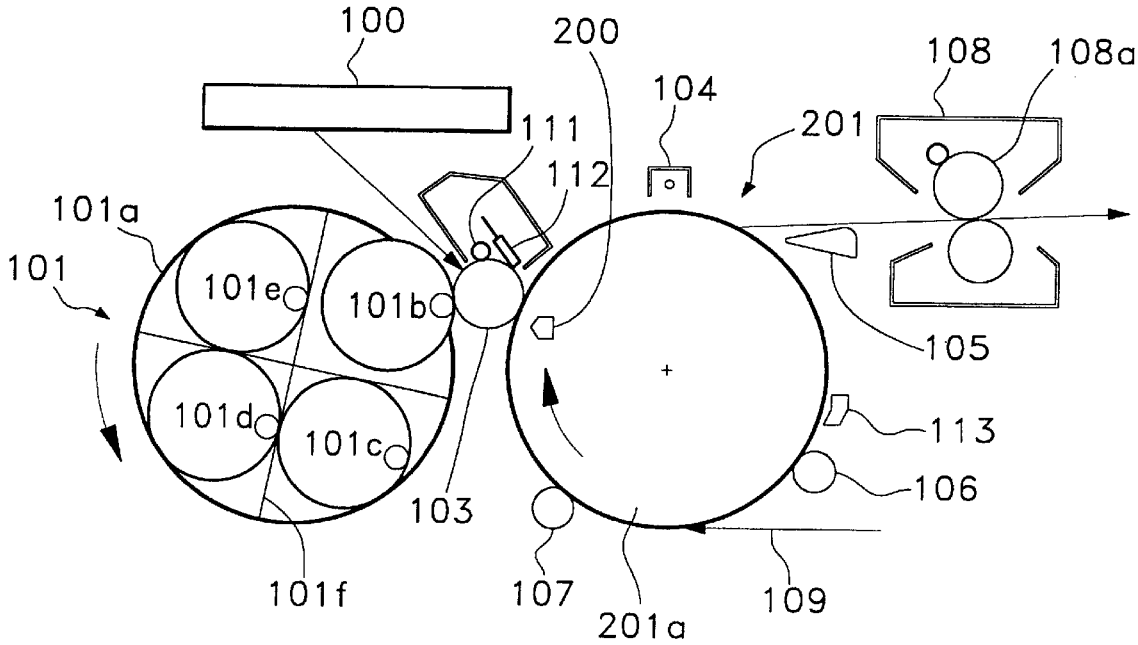
FIG. 5 is a structural view illustrating the position of a density control device applied to a color laser beam printer using an electrophotographic developing method according to the present invention.

FIG. 5 is a structural view illustrating the location of the density control device in the color laser beam printer using the electrophotographic developing method according to the present invention.

Referring to FIG. 5, there is shown a color laser beam printer including: a first charging unit 111 for charging the surface of a photosensitive drum 103 of a photosensitive device which is supported by a rotatable body with a predetermined electric potential; an exposing unit 100 for forming an electrostatic latent image by exposing the surface of the photosensitive drum 103 which is the photosensitive body used as the photosensitive device based on the image information; a rotatable developing unit 101 which is rotated in contact with the photosensitive drum 103 with an even pressure and forms repeatedly toner images of four colors successively at the electrostatic latent image formed on the surface of the photosensitive drum 103; a transfer unit 201 for transferring the multicolored toner images formed at the photosensitive drum 103 onto a recordable medium 109 which is fed by a pickup device; and a fixing unit 108 for heat-fixing the multicolored toner images which are transferred onto the recordable medium 109 by the transfer unit 201 with a heat roller 108*a*.

In the color laser beam printer having the aforesaid structure, as shown in FIG. 6, a transfer drum 201*a* which is a transfer body has a transfer cylinder 20. On the transfer cylinder 20, a dielectric sheet 21 such as a PET or a PVDF is adhered. A transparent window 22 having a predetermined size is formed so as to be communicably connected to the inside of the transfer cylinder 20 in the middle of the end portion of the dielectric sheet 21.

Moreover, a density control module 200 is located at the inside of the transfer drum 201*a*, and amplifies and outputs the toner density by detecting the density of the toner image formed at the surface of the photosensitive drum 103 which is the photosensitive body.

As shown in FIG. 7, the density control module 200 includes: a density detecting unit 200*a* which radiates an optical signal related to the toner image formed on the surface of the photosensitive drum 103 through the transparent window 22 of the transfer drum 201*a*, and then detects the density of the toner image with the reflected optical quantity which is reflected and received; a selecting unit 200*c* which selects one gain value and one residual offset value, respectively, from first and second gain values and the first and second residual offset values which are set differently according to the density values of the toner images detected by the density detecting unit 200*a*; and a density control value generating unit 200*b* which outputs a density control value through an output terminal 200*d* by amplifying, to a predetermined level, the density value of the toner image which is detected by the density detecting unit 200*a* based on the gain value and the residual offset value selected by the selecting unit 200*c*.

The density detecting unit 200*a* includes: a light emitting element 30 for radiating the light to the toner image formed on the surface of the photosensitive drum 103 through the transparent window 22 of the transfer drum 201*a*; a light receiving element 31 for receiving the light which is radiated from the light emitting element 30 and reflected according to the toner images formed on the surface of the photosensitive drum 103 through the transparent window 22, and for generating electrical signals corresponding to the received light; and a first amplifier 32 for amplifying the electrical signals generated by the light receiving element 31 to a predetermined level, and then outputting the amplified signals.

Moreover, the density control value generating unit 200*b* includes: first and second gain control units 34 and 35 which are selected by the conversion of the selecting unit 200*c* and generate different gain values; first and second offset control units 36 and 37 which generate different residual offset values by the conversion of the selecting unit 200*c*; and a second amplifier 33 which outputs the density control value through the output terminal 200*d* by controlling the gain and residual offset after amplifying the electrical signal on the density of the toner images inputted from the density detecting unit 200*a* based on the gain value and the residual offset value which are inputted after selected from the first and second gain control units 34 and 35 and the first and second offset control units 36 and 37, respectively.

Referring to FIGS. 5 to 7, the operation of preferred embodiments of the present invention having the above-identified structure will be explained as follows.

First, the recordable medium 109 which is fed by a pickup roller of a feeding device and then transported is adhered to the surface of the dielectric sheet 11 of the transfer drum 102*a* which is the transfer body by a high charging pressure of a charging roller 107 for adhesion.

At this time, the charging unit 111 charges the surface of the photosensitive drum 103, which is the rotating photosensitive body, with a predetermined electric potential. The exposing unit such as a laser diode exposes the image of a first color (i.e., magenta color) based on the image information with a predetermined timing and then forms the electrostatic latent image corresponding to the magenta color on the surface of the photosensitive drum 103 which is the photosensitive body.

As a developer 101*b* of the rotatable developing unit 101 is carried at a position facing the surface of the photosensitive drum 103, the electrostatic latent image formed on the surface of the photosensitive drum 103 is developed by the toner, and thereby the visible image is formed.

The toner image, which becomes the visible image, is rotated up to a position facing the transparent window 22, which is formed in the middle of the end portion of the dielectric sheet 21 of the transfer drum 201*a*, according to the rotation of the photosensitive drum 103.

The toner image which is rotated up to the position facing the transparent window 22 of the transfer drum 201*a* is transferred onto the recordable medium located on the dielectric sheet 21 of the transfer drum 201*a* by the transferring voltage which is applied to the transfer cylinder 20. At this time, the density detecting unit 200*a* of the density control module 200, which is located at the inside of the transfer drum 201*a*, detects the density of the toner image through the transparent window 22.

In other words, the toner image formed on the surface of the photosensitive drum 103 is a pattern for detecting the toner density. Here, when the transparent window 22 of the transfer drum 201*a* arrives at the photosensitive drum 103, the toner image formed on the surface of the photosensitive drum 103 is located facing the transfer drum 201*a*.

After that, when the toner image of the photosensitive drum 103 is located at the position facing the transparent window 22 of the transfer drum 201*a*, the light emitting element 30 of the density detecting unit 200*a*, which is located at the inside of the transfer drum 201*a*, radiates the optical signal to the toner image formed at the photosensitive body of the photosensitive drum 103 through the transparent window 22.

The optical signal is reflected according to the toner image, and is then received by the light receiving element 31 of the density detecting unit 200*a*, which will be illustrated, through the transparent window 22 of the transfer drum 201*a*.

In addition, the toner remaining on the surface of the photosensitive drum 103 is removed by a first cleaning unit 112, and the photosensitive drum 103 assumes a state capable of forming an image corresponding to the next color.

The toner, which is partly transferred to the transfer drum 201*a*, is removed by a second cleaning unit 113, and the surface of the transfer drum 201*a* becomes clean.

Moreover, the light receiving element 31 of the density detecting unit 200*a*, shown in FIG. 7, which is located at the inside of the transfer drum 201*a*, generates an electrical signal corresponding to the reflected light which is received from the light emitting element 30 through the transparent window 22, and supplies the signal to the first amplifier 32.

The first amplifier 32 converts the electrical current signal inputted from the light receiving element 31 into a voltage signal, and supplies the signal to the second amplifier 33 of the density control value generating unit 200*b*, which can control the amplification rate and residual offset.

The second amplifier 33 of the density control value generating unit 200*b* amplifies the voltage signal related to the reflection degree, which passes through the first amplifier 32 after detection by the light receiving element 31, and then supplies the amplified signal to a density operating device through the output terminal 200*d*. At this time, the selecting unit 200*c* of the density control module 200 selects the first gain control unit 34 and the first offset control unit 36 in the case of a toner image having a large reflection degree generated by the operation of the density operating device. In the case of a toner image having a small reflection degree, the selecting unit 200*c* selects the second gain control unit 35 and the second offset control unit 37.

When a toner image having a large reflection degree is considered, the second amplifier 33 of the density control value generating unit 200*b* amplifies, to a predetermined size, the density value of the toner image which is inputted as detected by the density detecting unit 200*a* based on a first gain value and a first residual offset value set in the first gain control unit 34 and the first offset control unit 36, respectively, thereby providing a density control value to a density operating device at a rear end through the output terminal 200*d*.

On the other hand, when a toner image having a small reflection degree is considered, the second amplifier 33 of the density control value generating unit 200*b* amplifies, to a predetermined size, the density value of the toner image which is inputted as detected by the density detecting unit 200*a* based on a second gain value and a second residual offset value set in the second gain control unit 35 and the second offset control unit 37, respectively, thereby providing a density control value to the density operating device through the output terminal 200*d*.

Here, the first gain value and the first residual offset value are larger than the second gain value and the second residual offset value, respectively.

As a result, in the case of the toner image having a large reflection degree, the second amplifier 33 amplifies the toner image with a small amplification rate. In the case of the toner image having a small reflection degree, the second amplifier 33 amplifies the toner image with a large amplification rate.

When the toner image of the first color is detected and the electrostatic latent image of the second color is formed on the surface of the photosensitive drum 103, the rotatable developing unit 101 is rotatably driven. As a result, the developer 101*c* is carried to a developing position of the photosensitive drum 103 and the toner image of the second color (i.e., yellow color) is formed on the surface of the photosensitive drum 103.

The developers 101*d* and 101*e* perform the above operation similarly to the developers 101*b* and 101*c*. In short, after completing the detection of the density of the toner image regarding each color and setting the optimum printing condition, heat-fixing is performed through the fixing unit 108, thereby completing the printing operation.

In contrast to prior arrangement, in which the density control module being exposed to contamination is located at a position facing the photosensitive drum 103, the present invention can detect accurately the toner density of the photosensitive body over the entire optical region by locating the density control module inside of the transfer body which is shielded.

Accordingly, in apparatus such as the color laser beam printer and the copier using the electrophotographic developing method, it is possible to obtain an optimum print output regardless of the remaining toner or other contamination by locating the density control module at the inside of the transfer body.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A density control method for an electrophotographic device which comprises a developing unit for forming multicolored toner images on an electrostatic latent image located at a photosensitive body, a transfer unit for transferring the multicolored toner images onto a recordable medium which is fed, and a fixing unit for heat-fixing the multicolored toner images transferred onto said recordable medium, said method comprising the steps of:

detecting a reflection degree of said toner images formed on a surface of said photosensitive body over an entire optical region by locating a density control module inside said transfer unit;

determining a gain value and a residual offset value corresponding to the reflection degree of said toner images which are detected;

amplifying the reflection degree of said detected toner images to a predetermined level using said gain value and residual offset value which are determined; and correcting the density of said multicolored toner images by controlling an electric potential of a latent image and a developing bias based on the reflection degree of said toner images which are amplified.

2. The density control method of claim 1, wherein said gain value is set to have a large value when the reflection degree of said detected toner images is small, and said gain value is set to have a small value when the reflection degree of said detected toner images is large.

3. The density control method of claim 1, wherein said gain value and said residual offset value are set to have large values when the reflection degree of said detected toner images is small, and said gain value and said residual offset value are set to have small values when the reflection degree of said detected toner images is large.

4. An electrophotographic device, comprising:

exposing means for forming an electrostatic latent image on a surface of a photosensitive body based on image information;

developing means for forming multicolored toner images on said electrostatic latent image;

transfer means for transferring said multicolored toner images onto a recordable medium, said transfer means having a density control module therein; and fixing means for heat-fixing said multicolored toner images transferred onto said recordable medium;

wherein said density control module comprises:

density detecting means for detecting a density value of said toner images formed on the surface of said photosensitive body, and for amplifying and outputting said detected density value:

means for selecting a gain value corresponding to said density value; and density control value generating means for generating a density control value by amplifying, to a predetermined level and based on said selected gain value, the density value of said toner images detected by said density detecting means.

5. The electrophotographic device of claim 4, wherein said density detecting means is located on an inside of said transfer means.

6. The electrophotographic device of claim 4, wherein said density detecting means comprises:

a light emitting element for radiating light toward the surface of said photosensitive body;

a light receiving element for receiving the light which is radiated from said light emitting element and reflected against the surface of said photosensitive body, and for generating an electrical signal corresponding to said reflected light; and first amplifying means for amplifying said electrical signal generated by the light receiving element to a predetermined level, and for outputting the amplified signal.

7. The electrophotographic device of claim 4, wherein said density control value generating means comprises:

first and second gain control units for generating different gain values; and an amplifier for outputting the density control value by amplifying, to a predetermined level, an electrical signal related to the density value of the toner images which is obtained by said density detecting means based on any one gain value selected from said first and second gain control units.

8. An electrophotographic device, comprising:

exposing means for forming an electrostatic latent image on a surface of a photosensitive body based on image information;

developing means for forming multicolored toner images on said electrostatic latent image;

transfer means for transferring said multicolored toner images onto a recordable medium, said transfer means having a density control module therein; and fixing means for heat-fixing said multicolored toner images transferred onto said recordable medium;

wherein said transfer means comprises:

a transfer cylinder;

a dielectric sheet which is formed on an outer periphery of said transfer cylinder and which has a predetermined thickness; and a transparent window which is formed so as to be communicably connected to an inside of said transfer cylinder in the middle of an end portion of said dielectric sheet.

9. An electrophotographic device, comprising:

exposing means for forming an electrostatic latent image on a surface of a photosensitive body based on image information;

developing means for forming multicolored toner images on said electrostatic latent image;

transfer means for transferring said multicolored toner images onto a recordable medium, said transfer means having a density control module therein; and fixing means for heat-fixing said multicolored toner images transferred onto said recordable medium;

wherein said density control module comprises:

detecting means for detecting a density value of said toner images formed on the surface of said photosensitive body, and for amplifying and outputting said detected density value;

selecting means for selecting at least one of a gain value and a residual offset value corresponding to said density value; and generating means for generating a density control value by amplifying, to a predetermined level, the density value of said toner images detected by said detecting means based on said selected at least one of said gain value and said residual offset value.

10. The electrophotographic device of claim 9, wherein said transfer means comprises:

a transfer cylinder;

a dielectric sheet which is formed on an outer periphery of said transfer cylinder and having a predetermined thickness; and a transparent window which is formed so as to be communicably connected to an inside of said transfer cylinder in the middle of an end portion of said dielectric sheet.

11. The electrophotographic device of claim 10, wherein said detecting means is located on an inside of said transfer means so as to face said transparent window.

12. The electrophotographic device of claim 9, wherein said generating means comprises:

first and second gain control units for generating different gain values;

first and second offset control units for generating different residual offset values; and an amplifier for outputting the density control value by amplifying, to a predetermined level, an electrical signal related to the density value of the toner images which is obtained by said detecting means based on one gain value selected from said first and second gain control units and one residual offset value selected from said first and second offset control units, respectively.

13. A density control method for use in an electrophotographic device having a photosensitive body and a transfer unit including a density control module, said method comprising the steps of:

locating the density control module inside said transfer unit;

detecting a reflection degree of toner images formed on a surface of said photosensitive body over an entire optical region; and correcting a density of multicolored toner images by controlling an electric potential of a latent image and a developing bias based on the reflection degree of said toner images, said method further comprising the step, after the detecting step, of determining at least one of a gain value and a residual offset value corresponding to the reflection degree of said toner images which are detected; and said method further comprising the step, after the determining step, of amplifying the reflection degree of said detected toner images to a predetermined level using said selected at least one of said gain value and said residual offset value which are determined.

14. A density control method for use in an electrophotographic device having a photosensitive body and a transfer unit including a density control module, said method comprising the steps of:

locating the density control module inside said transfer unit;

detecting a reflection degree of toner images formed on a surface said photosensitive body over an entire optical region; and correcting a density of multicolored toner images by controlling an electric potential of a latent image and a developing bias based on the reflection degree of said toner images;

said method further comprising the step, after the detecting step, of determining at least one of a gain value and a residual offset value corresponding to the reflection degree of said toner images which are detected; and wherein said gain value is set to have a large value when the reflection degree of said detected toner images is small, and said gain value is set to have a small value when the reflection degree of said detected toner images is large.

15. A density control method for use in an electrophotographic device having a photosensitive body and a transfer unit including a density control module, said method comprising the steps of:

locating the density control module inside said transfer unit;

detecting a reflection degree of toner images formed on a surface said photosensitive body over an entire optical region; and correcting a density of multicolored toner images by controlling an electric potential of a latent image and a developing bias based on the reflection degree of said toner images;

said method further comprising the step, after the detecting step, of determining at least one of a gain value and a residual offset value corresponding to the reflection degree of said toner images which are detected; and wherein said selected at least one of said gain value and said residual offset value is set to have a large value when the reflection degree of said detected toner images is small, and said selected at least one of said gain value and said residual offset value is set to have a small value when the reflection degree of said detected toner images is large.

16. An electrophotographic device, comprising:

exposing means for forming an electrostatic latent image on a surface of a photosensitive body based on image information;

developing means for forming multicolored toner images on said electrostatic latent image; and transfer means for transferring said multicolored toner images onto a recordable medium;

wherein said transfer means comprises a density control module located within an interior of said transfer means, and a transparent window formed in an exterior surface of said transfer means to provide optical communication between said density control module and the surface of said photosensitive body;

wherein said density control module comprises:

density detecting means for detecting a density value of said toner images formed on the surface of said photosensitive body, and for amplifying and outputting said detected density value;

means for selecting a gain value corresponding to said density value; and density control value generating means for generating a density control value by amplifying, to a predetermined level and based on said selected gain value, the density value of said toner images detected by said density detecting means.

17. The electrphotographic device of claim 16, further comprising fixing means for heat-fixing said multicolored toner images transferred onto said recordable medium.

18. The electrophotographic device of claim 16, wherein said density detecting means is located on an inside of said transfer means so as to face said transparent window.

19. The electrophotographic device of claim 16, wherein said density detecting means comprises:

a light emitting element for radiating light toward the surface of said photosensitive body through said transparent window;

a light receiving element for receiving the light which is radiated from said light emitting element and reflected against the surface of said photosensitive body through said transparent window, and for generating an electrical signal corresponding to said reflected light; and first amplifying means for amplifying said electrical signal generated by the light receiving element to a predetermined level, and for outputting the amplified signal.

20. The electrophotographic device of claim 16, wherein said density control value generating means comprises:

first and second gain control units for generating different gain values; and an amplifier for outputting the density control value by amplifying, to a predetermined level, an electrical signal related to the density value of the toner images which is obtained by said density detecting means based on any one gain value selected from said first and second gain control units.

21. The electrophotographic device of claim 16, wherein said selecting means selects at least one of a gain value and a residual offset value corresponding to said density value, and wherein said density control value generating means amplifies the density value of said toner images detected by said density detecting means based on said selected at least one of said gain value and said residual offset value.

22. An electrophotographic device, comprising:

exposing means for forming an electrostatic latent image on a surface of a photosensitive body based on image information;

developing means for forming multicolored toner images on said electrostatic latent image; and transfer means for transferring said multicolored toner images onto a recordable medium;

wherein said transfer means comprises a density control module located within an interior of said transfer means, and a transparent window formed in an exterior surface of said transfer means to provide optical communication between said density control module and the surface of said photosensitive body;

wherein said transfer means comprises:

a transfer cylinder; and a dielectric sheet which is formed on an outer periphery of said transfer cylinder and which has a predetermined thickness; and wherein said transparent window is formed so as to be communicably connected to an inside of said transfer cylinder in the middle of an end portion of said dielectric sheet.

23. A density control method for an electrophotographic device which forms multicolored toner images on an electrostatic latent image located on a photosensitive body, said method comprising the steps of:

detecting a reflection degree of said toner images formed on a surface of said photosensitive body over an entire optical region;

setting at least one of a gain value and a residual offset value to have a large value when the reflection of the defected toner images is small;

setting said at least one of said gain value and said residual offset value to have a small value when the reflection of the defected toner images is large;

amplifying the reflection degree of said detected toner images to a predetermined level using said at least one of said gain value and said residual offset value which are set; and correcting the density of said multicolored toner images based on the reflection degree of said toner images which are amplified.

24. The density control method of claim 23, wherein said detecting step is performed by locating a density control module inside a transfer unit of said electrophotographic device.

25. The density control method of claim 23, wherein a transparent window is formed in a middle of an end portion of a dielectric sheet included in a transfer unit of said electrophotographic device.

26. The density control method of claim 23, wherein said correcting step comprises controlling at least one of an electric potential of the electrostatic latent image and a developing bias of a developing unit of said electrophotographic device based on the reflection degree of said toner images which are amplified.

* * * * *